US005096181A

United States Patent [19]

Menon et al.

[11] Patent Number: 5,096,181

[45] Date of Patent: Mar. 17, 1992

[54] SHEET FEEDING AND DELIVERING APPARATUS HAVING STACK REPLENISHMENT AND REMOVAL FOR ALLOWING CONTINUOUS OPERATION

[75] Inventors: Sukumaran K. Menon, Webster, N.Y.; Morton Silverberg, Westport, Conn.; William F. Siegl, Rochester, N.Y.

[73] Assignee: Xerox Corporation, Stamford, Conn.

[21] Appl. No.: 552,052

[22] Filed: Jul. 13, 1990

[51] Int. Cl.[5] ..... B65H 1/26

[52] U.S. Cl. ..... 271/157; 271/147; 271/163; 271/289

[58] Field of Search ..... 271/9, 157, 158, 162-164, 271/213-215, 217, 289

[56] References Cited

U.S. PATENT DOCUMENTS

| | | | |
|---|---|---|---|
| 2,108,613 | 2/1938 | Rider | 271/157 |
| 2,921,788 | 1/1960 | Lawrence | 271/157 |
| 3,211,449 | 10/1965 | Welhouse | 271/158 |
| 3,288,463 | 11/1966 | Stuart | 271/158 |
| 3,369,805 | 2/1968 | Pierson et al. | 271/158 |
| 3,415,510 | 12/1968 | Mileski . | |
| 3,843,115 | 10/1974 | DiFulvio et al. | 271/157 |
| 3,975,011 | 8/1976 | Marass . | |
| 4,008,957 | 2/1977 | Summers . | |
| 4,046,370 | 9/1977 | Navi | 271/158 |
| 4,153,242 | 5/1979 | Mizuma . | |
| 4,174,831 | 11/1979 | Marass et al. . | |
| 4,418,907 | 12/1983 | Shultz et al. . | |
| 4,434,912 | 3/1984 | Larson | 271/157 |
| 4,452,440 | 6/1984 | Fagan et al. | 271/158 |
| 4,484,734 | 11/1984 | Tsudaka et al. . | |
| 4,525,063 | 6/1985 | Eisbein . | |
| 4,703,924 | 11/1987 | Marass | 271/162 |
| 4,801,135 | 1/1989 | Povio | 271/157 |

FOREIGN PATENT DOCUMENTS

| | | | |
|---|---|---|---|
| 171947 | 9/1985 | Japan | 271/162 |
| 204527 | 10/1985 | Japan | 271/9 |

*Primary Examiner*—Robert P. Olszewski
*Assistant Examiner*—Steven M. Reiss
*Attorney, Agent, or Firm*—Oliff & Berridge

[57] ABSTRACT

Sheet stack loader and sheet stack unloader arrangements provide load-while-run or unload-while-run capabilities. In a stack loader, a pusher element laterally pushes a stack or receiver into a sheet feed receiver. In a stack unloader, the pusher element pushes a finished stack from a stacking receiver to a removal receiver. By employing smooth paper support surfaces in the receivers, with close side-by-side positioning and an unobstructed path of movement, stacks of sheets of paper can be moved laterally by the pusher mechanism, which engages a side surface of the stack to be moved. Compact drive systems utilizing toggle drives and lead screws are utilized to minimize space requirements. Continuous run capabilities can be provided by auxiliary supply or stacking trays which are operative during the stack transfer sequence.

20 Claims, 6 Drawing Sheets

SHEET FEEDING AND DELIVERING APPARATUS HAVING STACK REPLENISHMENT AND REMOVAL FOR ALLOWING CONTINUOUS OPERATION

BACKGROUND OF THE INVENTION

1. Field of the Invention

This invention relates to the handling of stacks of sheet material and particularly to the supplying of or removal of stacks of paper from reproduction equipment to enable continuous running.

2. Description of the Related Art

Xerographic reproduction equipment is utilized in a wide variety of environments including relatively low volume office use to substantially higher volume contract reproduction uses. For lower volume uses, insertable trays and slidable drawers comprise effective means for holding supplies of sheets of paper on which copies are made. For high volume reproduction operations, users require large paper supply sources for maximization of machine running time which, correspondingly, requires a minimization of machine down time for such operations as reloading paper and unloading copies. For these reasons, it has become necessary to develop large capacity sheet feeding systems which allow continuous operation so that there is substantially no hiatus in the reproduction operation as the supply of sheets from one supply is exhausted and replaced with sheets from another supply. These systems further require the capability of loading additional stacks of paper while the machine continues to run. Similar considerations apply to equipment for unloading finished copies from such reproduction equipment.

In addition to fulfilling the above-described technical requirements, these systems are under cost and size constraints. Because the number of high volume machines sold is relatively low, in comparison to office size equipment, more simple designs help to prevent costs from being excessively high, as the cost must be amortized over a smaller number of units likely to be sold. In addition, space efficient designs minimize the floor space required for the equipment, which is a critical factor in metropolitan areas where floor space costs are high.

One arrangement for increasing paper supply in low volume desk top copiers is shown in U.S. Pat. No. 4,525,063. This design uses a double sided paper supply tray. When one side of the tray is exhausted, the user merely removes the tray and reinserts the other side of the tray into the machine. Such an arrangement is not suitable for high volume applications because of low capacity and the operator intervention required to switch the tray.

For higher volume operations, machines having large capacity supply trays, or multiple supply trays with means for switching from an empty tray to a full tray have been proposed. U.S. Pat. Nos. 3,415,510, 4,008,957 and 4,484,734 illustrate such systems. In general, the design of such systems and the controls for such systems are relatively more complex, take up more space, and are costly.

One design for providing stacks of sheets for high volume operation is shown in U.S. Pat. No. 4,153,242. This design utilizes two rolling carriages, one placed above the other with elevators for lifting carriages from their tracks to a feed position. Such an arrangement requires a costly elevator system for raising and lowering the carriages.

Other systems, such as shown in U.S. Pat. Nos. 3,975,011 and 4,174,831 employ a bottom feeding arrangement wherein a temporary holding means holds a portion of the stack in a feed position, while additional sheets are elevated into position from beneath. Thereafter, the temporary support means is removed and the supply stack is held in position by the stack elevator. Such systems require the temporary holding means which increases cost and space required for the feeder.

U.S. Pat. No. 4,418,907 shows a laterally movable stack tray. However, this design requires a stack elevator with increased vertical movement to pass upwardly beyond the sheet feeding rolls to add a stack of sheets from a resupply tray.

OBJECTS AND SUMMARY OF THE INVENTION

It is an object of the invention to provide a sheet stack handling apparatus having load-while-run or unload-while-run capabilities.

It is another object of the invention to produce such sheet stack handling apparatus having a compact design which minimizes space requirements It is yet another object of the invention to provide such sheet stack handling apparatus which is simple in design and has a low cost of manufacture.

These and other objects are achieved by stacking the apparatus having two side-by-side stack receivers, one receiver for supplying sheets to or receiving sheets from the reproduction equipment and the other receiver for holding an auxiliary stack of sheets to be supplied to the machine or for receiving the stack of sheets to be unloaded from the machine. A laterally movable pusher element moves a stack from one receiver to another receiver automatically upon the sensing of a need to move the stack from one receiver to another. Compact drive systems for the pusher element are utilized to minimize space requirements.

BRIEF DESCRIPTION OF THE DRAWINGS

The invention will be described in detail with reference to the following drawings in which like reference numerals refer to like elements and wherein.

DESCRIPTION OF THE PREFERRED EMBODIMENT

Figure 1:
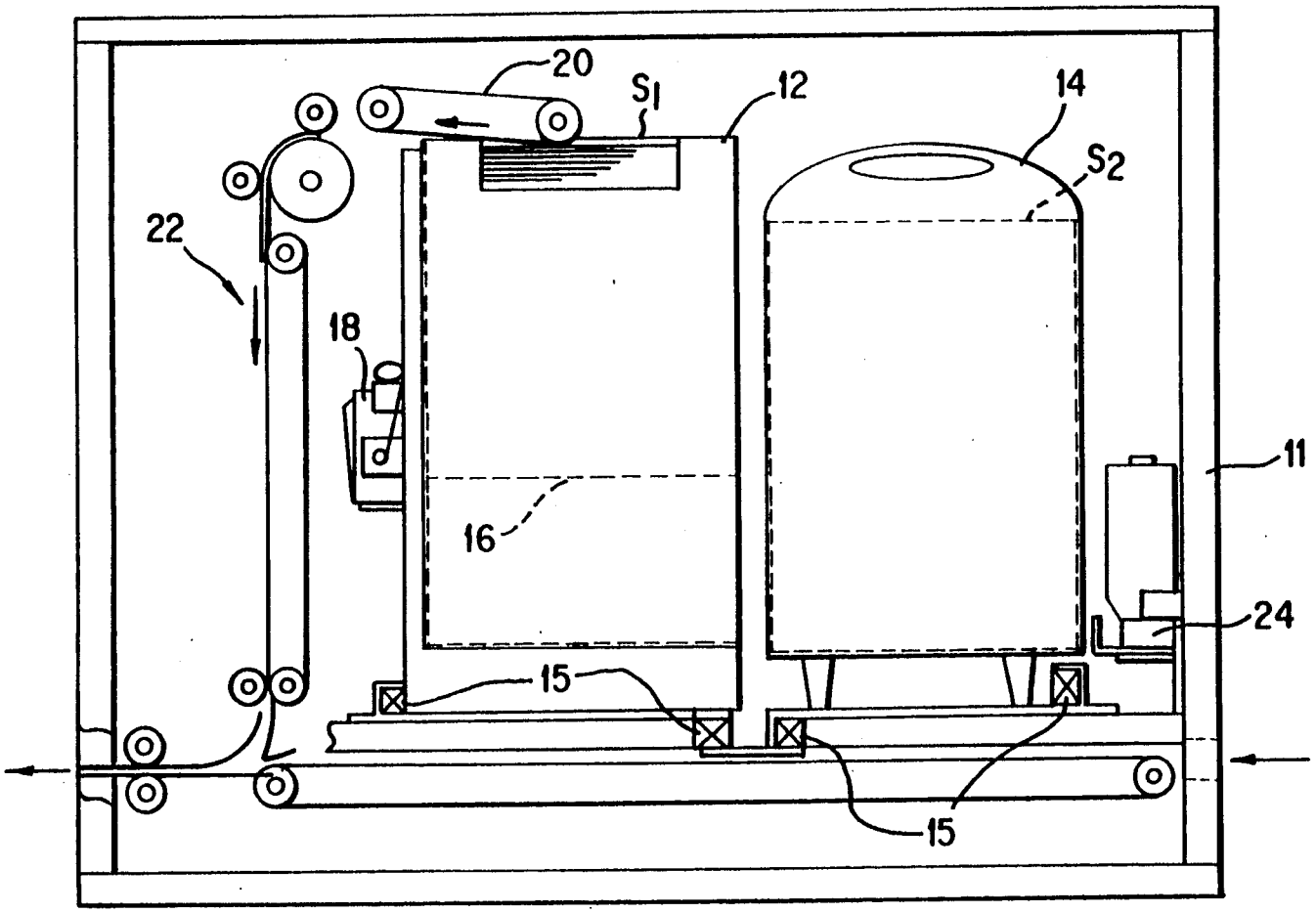
FIG. 1 is a side elevation of a stack handling system for loading stacks of sheets.

FIG. 1 shows a stack loading apparatus 10 having a frame 11. A first or sheet feeding stack receiver 12 is positioned within the frame and holds a first stack of paper sheets S1. A second or auxiliary stack receiver 14 is positioned adjacent to and in side-by-side relationship to the first receiver 12. An auxiliary supply stack of paper S2 is shown in the second receiver 14. The first receiver 12 and second receiver 14 are mounted by suitable means, such as rails 15, to be movable into and out of the loader 10 in directions perpendicular to the plane of FIG. 1, for purposes of loading stacks of paper into the receivers.

Individual sheets of paper are fed from the top of stack S1 by a sheet feeder 20 disposed adjacent the top of first receiver 12. As sheets are fed from the stack S1, the stack is raised by means of an elevator 16 so that the topmost sheet of paper in the stack S1 is positioned to be fed away from the stack by the sheet feeder 20. Designs of suitable feeders are known to those of skill in the art and further description is unnecessary for purposes of describing the invention. Sheets fed from the stack by the feeder 20 are fed into the paper handler 22 for subsequent processing, for example to be used as copy sheets in a xerographic reproduction process.

The receiver 12 also includes a drive motor 18 for raising and lowering the elevator 16. Specific elevator arrangements useful in this apparatus will be described in greater detail hereinafter.

The second receiver 14 holds an auxiliary stack of paper S2, which is to be placed in the receiver 12 when the stack 1 is exhausted. For this purpose, a pusher 24 mounted on the frame 11 is disposed adjacent the edge of the receiver 14 opposite to receiver 12. The pusher mechanism 24 will be described hereinafter in further detail.

Figure 2:
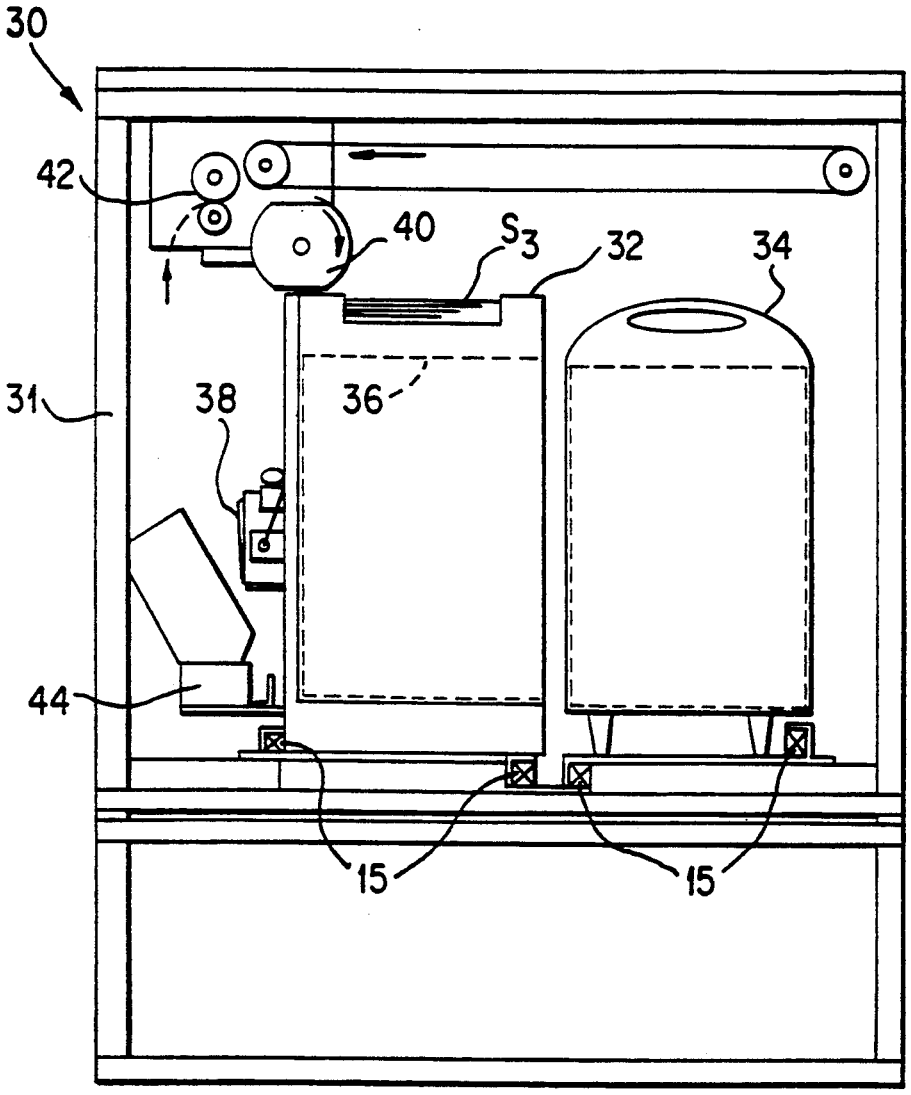
FIG. 2 is a side elevation of a stack handling system for unloading stacks of sheets.

Referring to FIG. 2, a stack unloading apparatus having a frame 31 is illustrated. Within the frame 31 is a first or stack forming receiver 32 and a second or stack unloading receiver 34. The stack receivers 32 and 34 are movable into and out of the stack unloader 30, as by rails 15, in directions perpendicular to the plane of FIG. 2. Such movement allows removal of stacks from the stack receivers 32 and 34 by an operator. Adjacent the top of the first receiver 32 is a rotating sheet unloader 40. Such unloaders are known and no further description thereof is necessary. The sheet unloader 40 receives sheets from sheet handling means including rollers 42, which sheets have been processed by upstream equipment and are ready for removal. The unloader 40 delivers each sheet to the top of a stack S3 in the first receiver 32. The stack S3 is supported on elevator 36, which is lowered progressively by the drive means 38 as additional sheets are repeatedly supplied to the stack S3. When the elevator 36 reaches the bottom of the receiver 32, the stack S3 is in position to be unloaded from the receiver 32. For this purpose, a stack pusher 44 is mounted on the frame 31 adjacent the first receiver 32. The pusher 44 moves stack S3 laterally out of the first receiver 32 into the second receiver 34.

Figure 3:
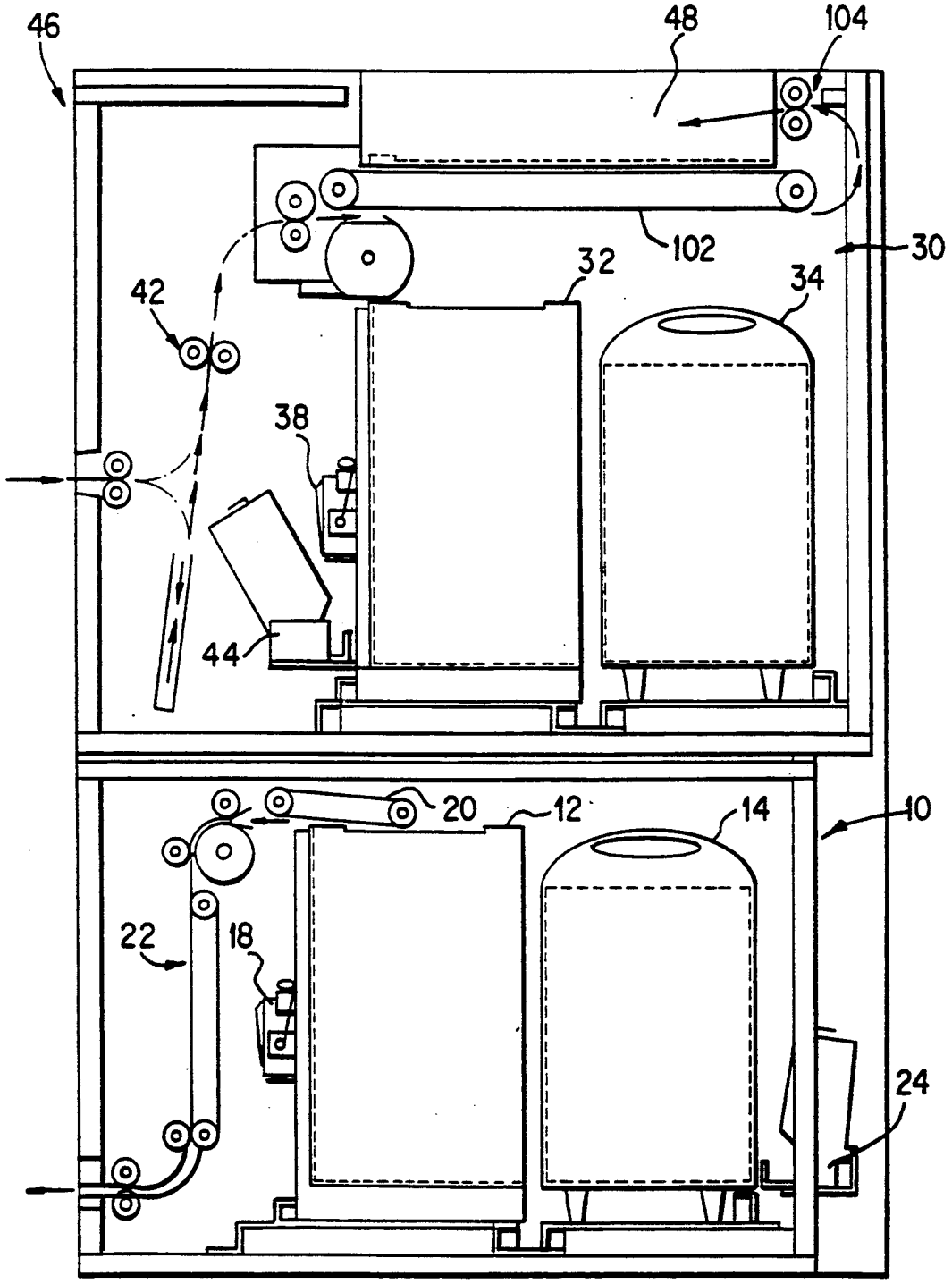
FIG. 3 is a side elevation of equipment for loading and unloading stacks of sheets.

FIG. 3 illustrates a loading and unloading arrangement using the stack loader 10 of FIG. 1 and the stack unloader 30 of FIG. 2, which yields a combined stack loader and unloader 46. The stack unloader 30 shown in FIG. 3 includes an additional tray 48 for receiving sheets which are not unloaded in the receiver 32. Because of the side-by-side arrangement of the respective receivers 12, 14 and 32, 34, the unloading unit 30 can be placed on top of the loading unit 10, or vice versa, thereby further minimizing floor space requirements.

Figure 4:
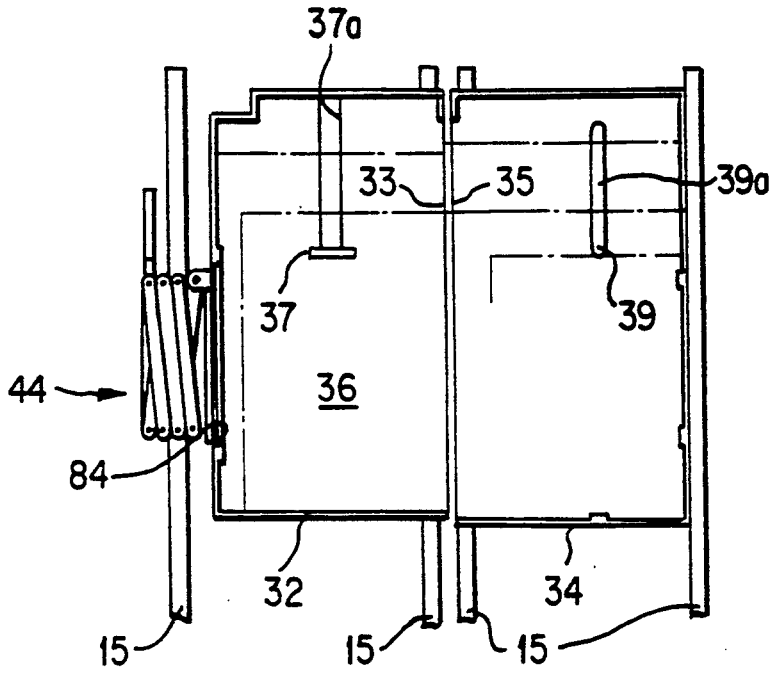
FIG. 4 is a top view of apparatus shown in FIG. 2.

FIG. 4 shows a top view of the stack unloader 30 of FIG. 2. This Figure shows the close side-by-side arrangement of the first receiver 32 and the second receiver 34. Each receiver has a substantially U-shaped configuration. The receivers are arranged in mutual opposed relationship, to present two adjacent unobstructed edges 33 and 35, respectively. Preferably, the elevator 36 includes a guide 37 slidable on a slot **37*a* for positioning a stack on the elevator 36. The guide 37 is movable in the slot 37*a* so that a plurality of sheet sizes can be accommodated. Similarly, the second receiver 34 includes a stop or guide 39 slidable in the slot 39*a*, also for the purpose of accommodating stacks of various sizes of paper. A similar arrangement is utilized for stack loader 10, with the exception that the pusher 24 is positioned adjacent second receiver 14**.

As shown in FIG. 4, the first receiver 32 includes an opening 84 in the side wall opposite the unobstructed edge 33. The pusher 44 enters the opening 34 and pushes a stack of sheets on the elevator 36 of the first receiver 32 into the receiver 34 and then returns to the position shown in FIG. 4.

Figure 5:
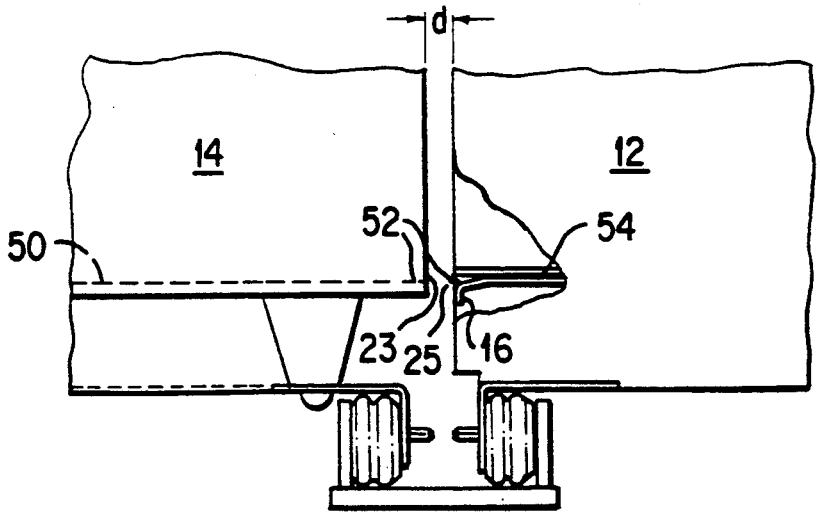
FIG. 5 is a partial sectional view of adjacent stack receivers.

FIG. 5 shows an enlarged view of the positioning of first receiver 12 and second receiver 14 of a stack loader and illustrates the relative positioning of the stack support surface 50 of the second receiver 14 and the stack support surface 54 of the elevator 16. Preferably the surface 50 and surface 54 include slightly chamfered or beveled surfaces 52 disposed along opposed, adjacent, unobstructed side edges 25 and 23 of the receivers 12 and 14, respectively. Also, surface 50 can be positioned slightly above surface 54 to facilitate transfer. The distance d between the receivers 12 and 14 is such that a stack can be slid along the support surface 50 onto the surface 54 of elevator 16. This dimension generally is on the order of ¼ inch. If the distance between the receivers is such that curling of the lowermost sheets is likely, an auxilliary support surface or roller (not shown) can be positioned between the receivers to effect smooth transfer of the stack. This transfer system relies in part on the observation that a stack of paper sheets can be moved along a surface by a lateral pushing force applied against one side of the stack and the stack will maintain its form as it moves, under the influence of the weight of the paper sheets in the stack. The entire stack, including the bottom most sheet, can be moved in this fashion. In order to effect such movement, it is desirable to support the stack for movement on a substantially planar surfaces having a coefficient of friction which allows the stack to move without sticking of the bottom most sheet of the stack to the surfaces 50 and 54. Planar plain or coated metal surfaces and other smooth planar surfaces have been found suitable for this purpose. The foregoing design considerations are also used in the unloader 30 with respect to receivers 32 and 34.

Figure 6:
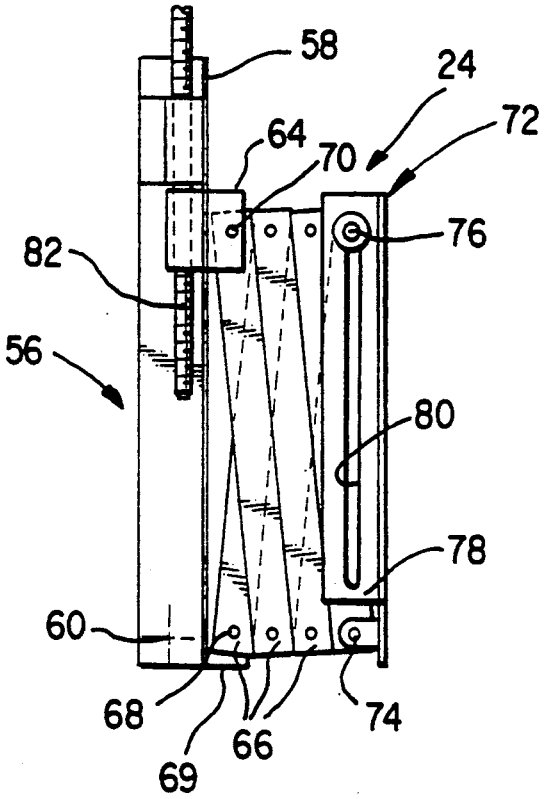
FIG. 6 is a top view of a stack pusher with a preferred form of drive.

A form of stack pusher useful for both pusher 24 and pusher 44 is shown in FIG. 6. In this construction, the guide 56 has an upstanding vertical portion 58 and a substantially horizontal portion 60. The portion 58 has a longitudinally extending slot 62 therein. A block 64 is slidable in slot 62 and is guided by the vertical portion 58. The pusher element includes a toggle joint structure comprising a plurality of rigid links 66 pivoted together at their ends. One of the lefthand end links is pivotably mounted on a fixed pivot plate 69 by a pin 68. The opposite lefthand end link is pivoted by a pin 70 on the slidable block 64. At the righthand side of the toggle, a pusher plate 72 is mounted thereon by means of a horizontally extending support plate 78 extending from one side of the vertical plate 72. One end of the plate 72 is pivotably mounted, as by pin 74, to one of the righthand end links 66. The other end of the plate 72 is mounted by a slidable pivot pin 76 to the other righthand end link 66. The pivot 76 slides in the slot 80 formed in the support plate 78. The pusher includes a rotatably mounted lead screw 82 driven by a suitable motor (not shown). The lead screw is received in a threaded bore of the slidable block 64 so that rotation of the lead screw 82 drives the block 64 transversely along the vertical portion 58 of the guide, in a direction governed by the direction of rotation of the lead screw 82. Movement of the slidable block 64 causes the toggle links 66 to extend from or retract toward the guide 58. The slidable pivot 76 allows the plate 72 to remain substantially parallel to the vertical portion 58, as the toggle drives the pusher plate 72, so that the plate moves the stack linearly. Alternatively, a gimbal mounting of the plate 72 can be used to assure that no rotation or angular movement is imparted to the stack as it is pushed.

Figure 7:
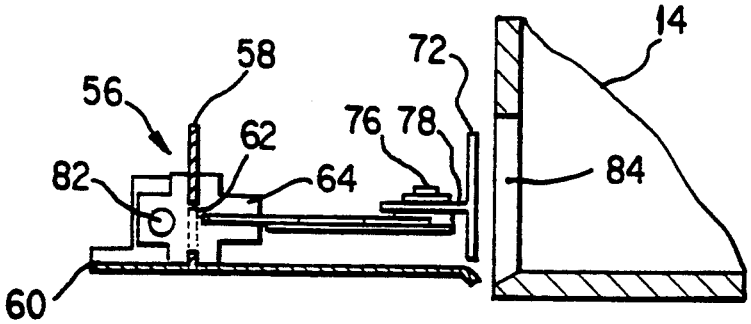
FIG. 7 is a side sectional view of the pusher element of FIG. 6 showing the relationship to a stack receiver.

As shown in FIG. 7, in retracted position, the pusher plate 72 is positioned adjacent an opening 84 in a side wall of the second receiver 14. As the lead screw 82 is rotated in an advancing direction, the plate enters the receiver 14 through the opening 84 and engages a side surface of a stack of paper in the receiver 14. Continued advancement of the lead screw 82 causes the pusher 72 to advance into the receiver 14 and push the stack from the receiver 14 into the receiver 12. When the stack is properly positioned in receiver 12, the drive of lead screw 82 is reversed and the pusher element is retracted out of the second receiver 14.

The pusher element 44 of the stack unloader 30 operates substantially in a similar manner to unload a stack from the first receiver 32 into the second receiver 34. Upon completion of the stack pushing operation for loader 10 or unloader 30, the respective second receiving means 14 and 34 can be moved out of the loader or unloader. In the case of a stack loader, a new stack of paper can be placed in the second receiver 14 by the operator, while the feed from stack S1 in stack receiver 12 continues. Similarly, with the unloader 30, a completed stack can be removed from the second receiver 34 by the operator as a subsequent stack is formed in the first receiver 32.

Figure 8:
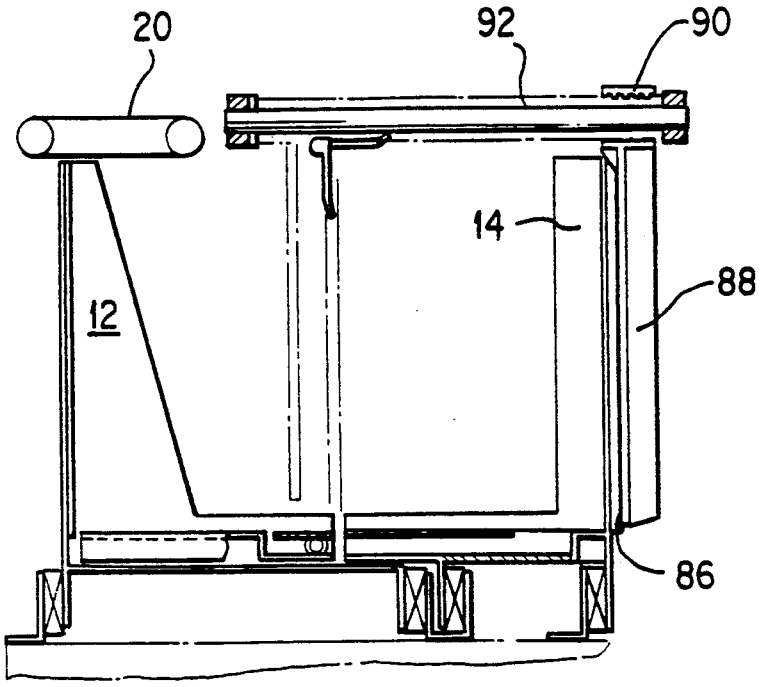
FIG. 8 is a schematic illustration of another form of drive for the stack moving element.

FIG. 8 shows an alternate form of stack pusher having a plate 86 mounted on a depending support 88. At the top of the support 88 is a threaded collar 90 received on a lead screw 92 rotatably supporting in a frame, such as frame 11 of loader 10. In the full line position of FIG. 8, the plate 88 is in retracted position adjacent one edge of the second receiver 14. Rotation of the lead screw 92 causes movement of the plate 88 to the dotted line position to advance a stack of sheets from the second receiver 14 into the first receiver 12. Reverse rotation of the lead screw 92 causes the plate 86 to return to the full line position adjacent an edge of the second receiver 14. Because the lead screw 92 overlies the receivers 12 and 14, little additional lateral space is needed for the drive, thereby minimizing floor space requirements.

Figure 9:
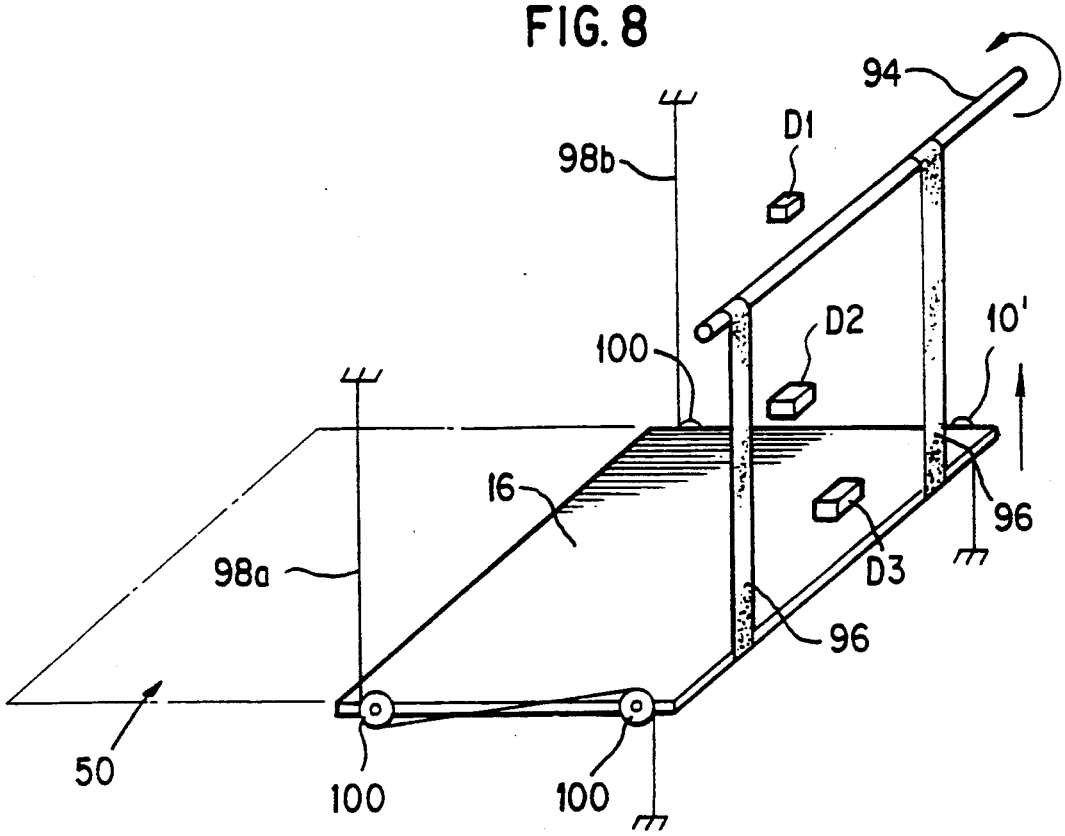
FIG. 9 is a schematic illustration of a stack elevator.

As was previously mentioned, it is desirable to provide receivers having adjacent unobstructed edges. Referring to FIG. 9, one form of elevator structure which provides such a construction is shown. In this design, a rotatable drive shaft 94 has a pair of belts or straps 96 fixed thereon. The lower ends of the straps 96 are fixed to one edge of the elevator 16. The sides of the elevator 16 are supported by cables 98*a* and 98*b*, the ends of which are fixed to portions of the receiver. Side edges of the elevator 16 are supported on the cables 98 by grooved rollers 100. Rotation imparted to drive shaft 94 by motor 18 (FIG. 1) in one direction causes the straps 96 to be wound on the shaft thereby raising the elevator 16. Rotation in the opposite direction allows the elevator 16 to be lowered. The opposed pulleys on each side of the elevator 16 provide countermoments of equal magnitude which prevent tipping of the elevator and cause it to remain in a horizontal position. Other elevator arrangements are also usable. One such arrangement would employ vertically extending lead screws on each side of the elevator 16 and positioned outside of the surface 54 to provide an unobstructed edge for stack transfer.

An advantage of the disclosed loader/unloader designs is that controls are simplified. For example in the stacker of Figure employing an elevator 16 as described in FIG. 9, two detectors D1 and D2 are provided. As individual sheets are fed by sheet feeder 40, the elevator 16 maintains contact of the topmost sheet of the stack S1 with the feeder 20. D1 is preferably an optical sensor positioned to detect the presence of the topmost sheet of the stack by reflectance of light from the paper. When the last sheet is fed, the detector D1 detects the absence of a sheet and allows the elevator 16 to descend to a stack receiving position, as shown in FIG. 5. The position of the elevator in its lowermost position is detected by detector D2, the output signal enables drive of the motor for the pusher 24 (FIG. 1), initiating movement of the auxiliary stack onto the elevator 16. Appropriate limit switches (not shown) on the pusher 24 (FIG. 1) control proper positioning of the stack on the elevator 16 and retraction of the pusher to a position adjacent the side wall of the second receiver 14. Detector D3, which can be a mechanical switch or optical detector, senses the correct positioning of the stack on the elevator and enables start up of the elevator and commencement of the sheet feeding operation. The outputs of the detectors D1, D2 and D3 are supplied to a suitable machine logic control system such as a microprocessor implemented control. Such controls are within the skill of a designer in this art and no further details regarding such systems are necessary.

For the stack unloader of FIG. 2, the operating sequence is essentially reversed. As the elevator 16 is lowered to its lowermost position, detector D2 detects this lowermost position and controls operation of the stack pusher 44 (FIG. 2). In this case, detector D1 detects the upper position of the elevator and stops it in that position to receive sheets from the stacker element 40.

The foregoing descriptions of the stack loader of FIG. 1 and stack unloader of FIG. 2 have described the load-while-run and unload-while-run capabilities of the equipment. Namely, as the auxiliary stack is moved from the second receiver 14 or the stack to be unloaded is moved into the second receiver 34, the operator can withdraw the second receiver from the unit to, respectively, load a new auxiliary stack or unload a finished stack, while a paper feeding continues in the first receiver 12 or a paper stacking continues in the first receiver 32. The system is also adaptable for use in a continuous run mode. That is, while the pusher mechanisms 24, 44 are being operated to transfer stacks, the feed of paper from or discharge of paper to auxiliary trays can continue. For the unloader 10, an auxiliary feed tray and suitable control system can be utilized to provide an uninterrupted supply of sheets to the reproduction apparatus. For example, a tray system such as shown in U.S. Pat. No. 4,008,957, the disclosure of which is incorporated herein by reference, can be utilized for such purposes. For the stacker unloader 30, a system such as shown in FIG. 3 can be utilized. In this case, when the stacking of paper by stacker member 40 must be interrupted to enable stack movement, the sheets fed from the apparatus can be conveyed by belt 102 and suitable sheet handling equipment, including rollers 104, to dispense the sheets into tray 48. Upon completion of the stack moving operation and return of the elevator 36 to sheet receiving position, the feed of sheets to belt 102 is terminated. Control systems for effecting such operation are within the skill of those in the art and would utilize, in part, the detectors D1 and D2 for control signals.

It can be seen from the foregoing description that the disclosed stack loader/unloader design provides substantial advantages in terms of simplicity of construction and design. In addition, the drive systems for the stack pusher are compact and result in units which have low floor space requirements. For example, the designs can accommodate two stacks of 2500 sheets of $8\frac{1}{2}\times 11$, A4, or A3 paper and thus provide high volume capacity and lessen down time and operator attendance requirements. Because of the side-by-side receiver design, the unit also has the added flexibility of use for feeding large sheets, which would be supported on both the first and second receivers. In this latter case, a suitable elevator might be used in the second receiver or the supporting surface in the second receiver may be locked to the elevator so that the elevator and support surface move together.

What is claimed is:

1. Apparatus for feeding sheet material comprising:

first receiver means having a surface for directly supporting a first stack of sheets;

means for repeatedly feeding a topmost sheet of the first stack of sheets away from the stack;

elevator means for vertically raising the first stack of sheets as sheets are fed away from the stack, said elevator means being movable from a lower position to an upper position;

second receiver means having a surface for directly supporting a second stack of sheets, said second receiver means being disposed adjacent the first receiver means;

moving means for laterally pushing a second stack of sheets from the supporting surface of the second stack receiving means to the stack supporting surface of the first stack receiving means, said moving means being movable from a first position adjacent an edge of the second receiver means to a second position adjacent an edge of the first receiver means;

sensing means for sensing the absence of sheets in the first receiver means;

means responsive to the sensing means for returning the elevator means from the upper position to a lower position and means for causing the stack moving means to move the stack of sheets in the second stack receiving means to the first stack receiving means when the elevator means is in said lower position; and means for returning the moving means to said first position.

2. Apparatus as in claim 1, wherein the moving means comprises a plate for engaging a side surface of a stack of sheets and drive means for moving said plate.

3. Apparatus as in claim 2, wherein the drive means includes a toggle joint.

4. Apparatus as in claim 3, wherein the drive means further includes a lead screw and means for rotating the lead screw to effect extension and retraction of the toggle joint.

5. Apparatus as in claim 4, wherein the lead screw extends adjacent to and substantially parallel to an edge of one of the stack receiving means and substantially perpendicular to the direction of movement of a stack.

6. Apparatus as in claim 2, wherein the drive means comprises a lead screw extending substantially parallel to the direction of movement of a stack of sheets from the second receiver means to the first receiver means.

7. Apparatus as in claim 6, wherein the lead screw is positioned adjacent a top portion of the second stack receiver.

8. Apparatus as in claim 2, wherein the plate is substantially vertical and said drive means moves said plate substantially horizontally.

9. Apparatus for handling stacks of sheet material comprising:

a first receiving means for receiving a stack of sheet material; and means for automatically moving a stack of sheet material from the first receiving means to the second receiving means comprising a pusher element for laterally urging the stack from the first stack receiving means to the second stack receiving means, the pusher element comprising means for engaging a side of a stack of sheets in one of said stack receiving means and means for driving said stack engaging means in a horizontal direction to push the stack from said one stack receiving means into the other of said stack receiving means, wherein the stack moves relative to both said stack receiving means, said means for driving being located behind said pusher element and adjacent the side of the stack of sheets.

10. Apparatus as in claim 9, wherein the drive means includes a toggle joint.

11. Apparatus as in claim 10, wherein the drive means further includes a lead screw and means for rotating the lead screw to effect extension and retraction of the toggle joint.

12. Apparatus as in claim 11, wherein the lead screw extends adjacent to and substantially parallel to an edge of one of the stack receiving means and substantially perpendicularly to the direction of movement of a stack.

13. Apparatus as in claim 9, and further comprising means for determining the absence of sheets in one of said stack receiving means and means responsive to said determining means for controlling movement of said moving means.

14. Apparatus as in claim 9, wherein each receiving means includes a substantially planar horizontal surface for receiving and supporting a stack of sheets.

15. Apparatus as in claim 14, wherein each receiving means is open at one side to provide for lateral unobstructed movement of a stack of sheets from one receiving means to the other receiving means and wherein said open sides of each receiving means are adjacent each other.

16. Apparatus as in claim 15, wherein the first receiving means includes means for vertically moving the planar surface therein and said moving means includes means for positioning said planar surface in substantially coplanar relationship with the planar surface in the second receiving means.

17. Apparatus as in claim 9, wherein said stack engaging means is a plate.

18. Apparatus as in claim 9, further comprising auxiliary means for handling sheet material in a continuous run mode including:

detector means for detecting stack movement; and sheet handling means for bypassing said first and second receiving means when stack movement is detected.

19. Apparatus for handling stacks of sheet material comprising:

a first receiving means for receiving a stack of sheet material;

a second receiving means for receiving a stack of sheet material; and the first stack receiving means having a stack receiving surface therein;

the second stack receiving means having a stack receiving surface therein;

means, including said stack receiving surfaces, for defining a path of movement for stacks of sheet material from one of the stack receiving means to the other of the stack receiving means;

means for moving a stack of sheet material relative to said first and second receiving means along said path; and means responsive to a sheet stack condition in one of the stack receiving means for enabling said moving means.

20. Apparatus as in claim 19, wherein each receiving means is open at one side to provide for lateral unobstructed movement of a stack of sheets from one receiving means to the other receiving means and wherein said open sides of each receiving means are adjacent each other.

* * * * *